US009217268B2

(12) United States Patent
Lautenschlager

(10) Patent No.: US 9,217,268 B2
(45) Date of Patent: Dec. 22, 2015

(54) FURNITURE HINGE

(75) Inventor: Horst Lautenschlager, Reinheim (DE)

(73) Assignee: LIBERTY HARDWARE MFG. CORP., Winston-Salem, NC (US)

( * ) Notice: Subject to any disclaimer, the term of this patent is extended or adjusted under 35 U.S.C. 154(b) by 1094 days.

(21) Appl. No.: 11/699,193

(22) Filed: Jan. 29, 2007

(65) Prior Publication Data

US 2008/0178426 A1 Jul. 31, 2008

(51) Int. Cl.
*E05D 7/04* (2006.01)
*E05D 5/08* (2006.01)

(52) U.S. Cl.
CPC ..... *E05D 7/0415* (2013.01); *E05D 5/08* (2013.01); *E05D 2007/0484* (2013.01); *E05Y 2900/20* (2013.01); *Y10T 16/5329* (2015.01)

(58) Field of Classification Search
USPC ..... 16/242, 243, 245, 235, 237, 238, 246, 16/236, 360, 361
See application file for complete search history.

(56) References Cited

U.S. PATENT DOCUMENTS 4,359,803 A * 11/1982 Lautenschlager ..... 16/272
4,509,229 A * 4/1985 Salice ..... 16/327
5,621,947 A * 4/1997 Fitz et al. ..... 16/249
5,930,866 A * 8/1999 Rupprechter ..... 16/242
6,125,508 A * 10/2000 Formenti ..... 16/335
6,442,798 B1 * 9/2002 Rupprechter ..... 16/242
6,622,343 B2 * 9/2003 Rupprechter ..... 16/242
6,643,895 B1 * 11/2003 Domenig et al. ..... 16/238
6,845,544 B2 * 1/2005 Hofer ..... 16/246
6,880,205 B2 * 4/2005 Rupprechter ..... 16/235
6,904,645 B1 * 6/2005 Lautenschlager ..... 16/382
6,996,877 B2 * 2/2006 Booker et al. ..... 16/257
7,017,231 B2 * 3/2006 Isele ..... 16/242
7,231,691 B1 * 6/2007 Domenig et al. ..... 16/236
7,591,044 B2 * 9/2009 Migli ..... 16/235
2004/0163211 A1 * 8/2004 Rucker ..... 16/235
2005/0251961 A1 * 11/2005 Liu ..... 16/242
2006/0143859 A1 * 7/2006 Wu ..... 16/242
2006/0236503 A1 10/2006 Migli

* cited by examiner

*Primary Examiner* — Robert J Sandy
*Assistant Examiner* — Rowland Do
(74) *Attorney, Agent, or Firm* — Carlson, Gaskey & Olds P.C.

(57) ABSTRACT

A furniture hinge includes a carrier arm and a door fitting having a recessed cup that is rotatably disposed at one end of the carrier arm. A fastening plate is adjustably connected to another end of the carrier arm. A mounting plate is longitudinally adjustably attached to the fastening plate and is attachable to a furniture body. Either the fastening plate or the mounting plate includes a guide wall having a guide slot where the guide wall is bent perpendicularly to a plane of the respective plate. The other of the fastening plate or the mounting plate includes a guide tongue extending into the guide slot where the guide tongue is parallel to a plane of the other respective plate.

14 Claims, 2 Drawing Sheets

FURNITURE HINGE

BACKGROUND OF THE INVENTION

The invention relates to a furniture hinge and, more particularly a furniture hinge with a door fitting in the form of a recessed cup that is rotatably accommodated on one end of a carrier arm and on the other end of the carrier arm a fastening plate that is adjustably accommodated and longitudinally adjustably connected to a mounting plate attached to a furniture body.

Furniture hinges serve to rotatably attach a furniture door to a piece of furniture. In order to permit adjustment of the hinge axis perpendicularly to the front surface of the furniture, the fastening plate is connected to the carrier arm in such a way that the fastening plate can be adjusted longitudinally with respect to the mounting plate. The fastening plate is thereby guided in the direction of adjustment on the mounting plate by means of, for example, bent flanges on both longitudinal edges of the fastening plate, which flanges straddle the mounting plate.

The fastening plate is usually connected to the mounting plate on the side facing the interior of the furniture by means of a longitudinal adjustment means. A longitudinal guide for the fastening plate must be provided on the other side of the mounting plate, the side directed toward the exterior.

Here it is known to provide a stud extending on both sides of the mounting plate, which stud protrudes into a longitudinal guide slot in the bent flanges of the fastening plate, which can thereby be displaced along with these studs. The studs can, for example, be provided in the form of a penetrating pin.

This longitudinal guide between the fastening plate and the mounting plate is relatively expensive, particularly since at least one extra component must be provided to form the stud, the manufacture of which increases the production and assembly costs. Additionally, the sideways protrusion of the stud can be inconvenient, for example, during cleaning, when cleaning materials such as dusting clothes become snagged on it.

The purpose of the invention is therefore to provide a furniture hinge of the kind cited in the introduction that achieves longitudinal guidance between the fastening plate and the mounting plate by means of a simple design and particularly without protruding parts.

SUMMARY OF THE INVENTION

An example furniture hinge includes a carrier arm and a door fitting having a recessed cup that is rotatably disposed at one end of the carrier arm. A fastening plate is adjustably connected to another end of the carrier arm. A mounting plate is longitudinally adjustably attached to the fastening plate and is attachable to a furniture body. Either the fastening plate or the mounting plate includes a guide wall having a guide slot where the guide wall is bent perpendicularly to a plane of the respective plate. The other of the fastening plate or the mounting plate includes a guide tongue extending into the guide slot where the guide tongue is parallel to a plane of the other respective plate.

In one example, the longitudinal guidance between the mounting plate and the fastening plate is achieved by using components that are produced by stamping. For example, the fastening plate and the mounting plate are stamped metal and consequently do not require extra production steps. The guide wall is formed guide and the slot is punched out during the stamping. The guide tongue, which is bent at a right angle to a base plate of the mounting plate in one example, is also formed during the stamping of the mounting plate without any extra production step being required.

In one example, the guide wall with its guide slot and the guide tongue lie in an interior of the space enclosed by the fastening plate and the mounting plate so that no components extend outward to pose a problem or increase the external dimensions of the furniture hinge.

The various features and advantages of this disclosure will become apparent to those skilled in the art from the following detailed description. The drawings that accompany the detailed description can be briefly described as follows.

DETAILED DESCRIPTION OF THE PREFERRED EMBODIMENT

Figure 1:
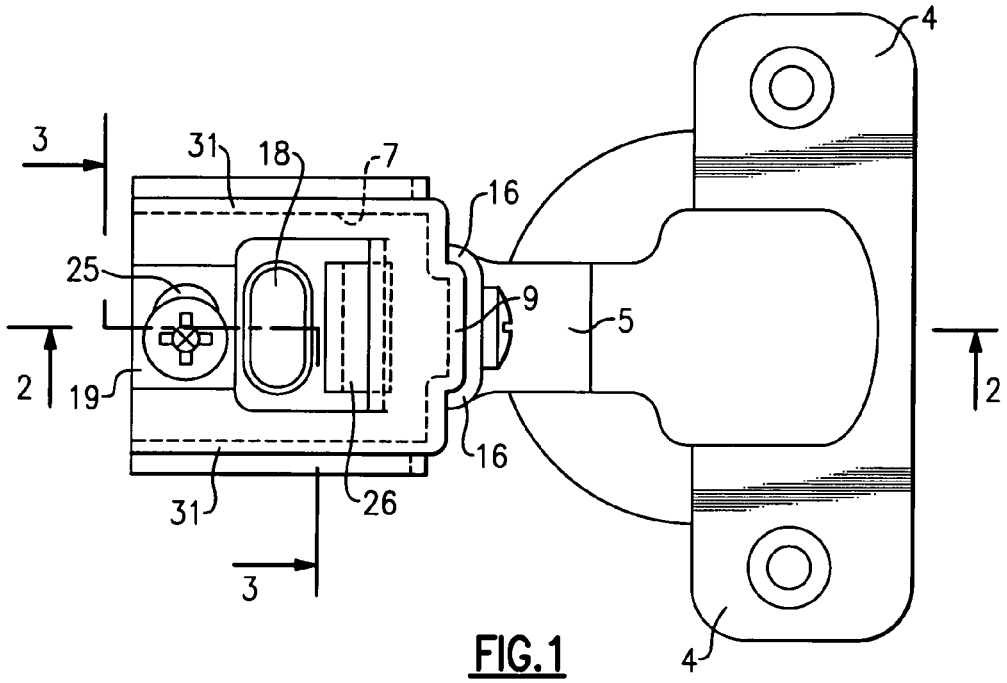
FIG. 1 shows a furniture hinge in the open state in a vertical view.

The furniture hinge shown in FIGS. 1-4 serves for rotatable attachment of a furniture door 1 on a piece of furniture. For example, the furniture hinge provides rotatable attachment on the front frame 2 of a piece of furniture having a "face-frame" design.

In the disclosed example, the furniture hinge includes a door fitting component in the form of a recessed cup 3 that is attached to the furniture door 1 using fastening screws (not shown) through side attachment ears 4.

The furniture hinge includes a carrier arm 5 formed from sheet-metal. The carrier arm 5 includes a rotating hinge on its door end. The rotating hinge includes a hinge pin 6 on which the recessed cup 3 is rotatably disposed on carrier arm 5. A fastening plate 7 is adjustably attached to the other end of carrier arm 5. In the illustrated example, the fastening plate 7 consists of a sheet metal stamping that is connected to a mounting plate 8. The mounting plate 8 also consists of a sheet metal stamping, which is screwed onto the front frame (FIG. 2).

The other end of carrier arm 5 (i.e., the end away from furniture door 1) bears against a front wall 9 of the fastening plate 7. In the disclosed example, the front wall 9 is oriented perpendicular to a plane of the fastening plate 7, and the mounting plate 8 and is adjustably attached to the fastening plate 7 using a lateral adjustment member 10. The front wall 9 is oriented perpendicular to the plane of fastening plate 7. An eccentric component 11 is rotatably disposed on front wall 9 using a mounting pin 12. An eccentric section 13 of the mounting pin 12 extends into a guide slot 14 in the carrier arm 5. In this example, the eccentric component 11 can be adjusted using an adjusting tool, for example, by using Philips screw head 15.

When the eccentric component 11 is turned, the eccentric component displaces the carrier arm 5 along front wall 9. The end of carrier arm 5 directed toward the front wall 9 includes lateral flanges 16 that straddle and guide the two side edges of the front wall 9. Thus, the lateral adjustment member 10 provides the benefit of lateral adjustment of the furniture door 1 with respect to the furniture body.

Figure 2:
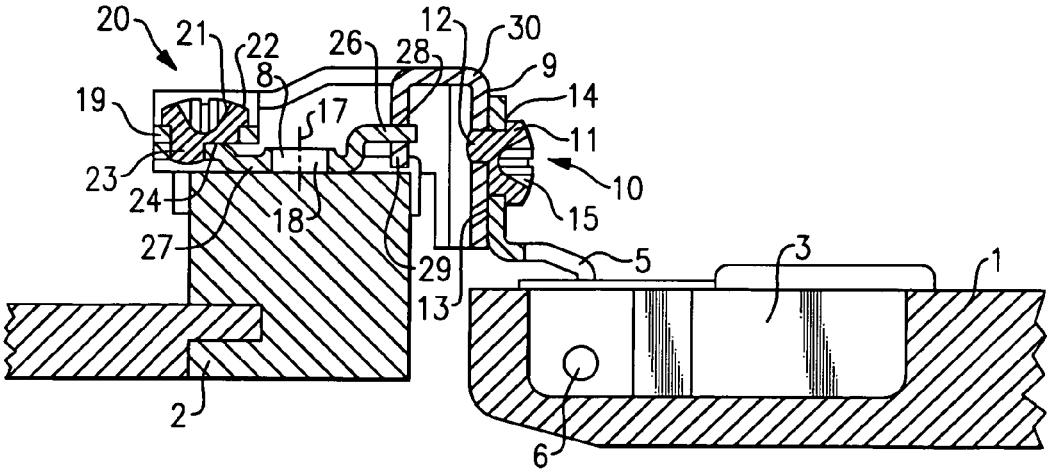
FIG. 2 shows a cross-section along the section line 2 in FIG. 1.
Figure 3:
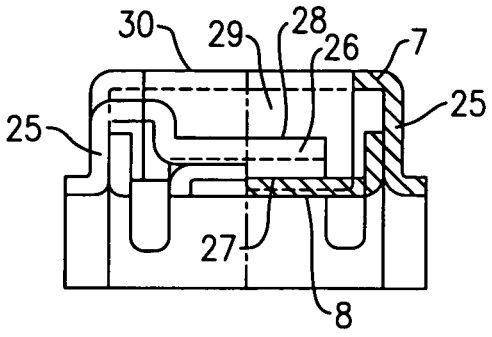
FIG. 3 shows a cross-section along the section line 3 in FIG. 1.
Figure 4:
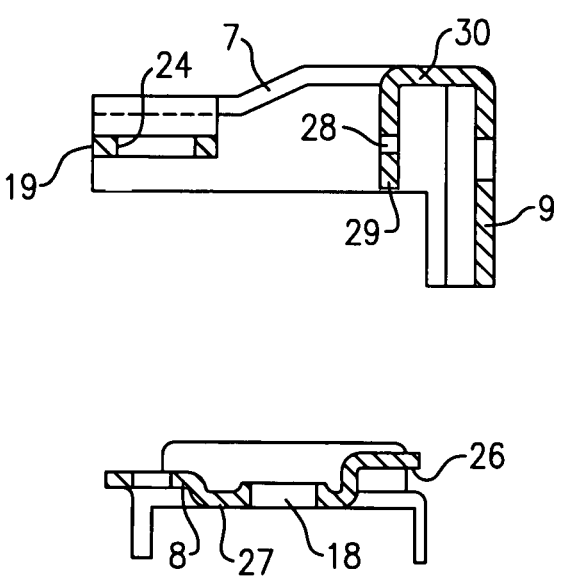
FIG. 4 shows a cross-section through the mounting plate and the fastening plate of the furniture hinge in accordance with FIGS. 1-3 in a disassembled condition.

The mounting plate 8 is attached to the front frame 2 using an attachment screw 17 (FIG. 2). Attachment screw 17 grips through an elongated hole 18 that extends perpendicular to the long dimension of the mounting plate to permit height adjustment in attachment mounting plate 8.

A cross-step 19 in the fastening plate 7 is connected to the mounting plate 8 using a longitudinal adjustment member 20. In this example, the longitudinal adjustment member 20 is similar in design to the lateral adjustment member 10. An eccentric component 22 is rotatably disposed on a mounting pin 23 and can be adjusted using an adjusting tool, for example, a Philips screw head. An eccentric section 24 of the eccentric component 22 fits into a transverse slot 31 in the cross-step 19. By turning the eccentric component 22, the eccentric component longitudinally adjusts the position of the fastening plate 7 relative to mounting plate 8 (i.e., horizontally in FIG. 1), which is fixed to the piece of furniture. The fastening plate 7 grips the longitudinal edges of mounting plate 8 using edge flanges 25 and is thus guided in the longitudinal direction.

In the disclosed example, the door-end of the mounting plate 8 includes a guide tongue 26 for guiding movement between the fastening plate 7 and mounting plate 8. The guide tongue 26 extends parallel to the plane of mounting plate 8 and includes a 90° bend relative to a base plate 27 of the mounting plate 8. The guide tongue 26 fits into a guide slot 28, which in this example is cut into a guide wall 29 of the fastening plate 7. The guide wall 29 is oriented perpendicular to the plane of fastening plate 7.

The guide wall 29 is bounded by upper wall 30 of the fastening plate 7, which is spaced a distance from the base plate 27 of the mounting plate 8. The front wall 9 of the fastening plate 7 is parallel to and spaced from guide slot 28 in the guide wall 29 of the fastening plate 7.

Instead of the arrangement shown in the exemplary embodiment, in which the guide tongue 26 is formed on mounting plate 8 and the guide slot 28 is formed on the fastening plate 7, the reverse arrangement may be selected in which mounting plate 8 includes a guide wall with a guide slot and the fastening plate includes a guide tongue.

Although a combination of features is shown in the illustrated examples, not all of them need to be combined to realize the benefits of various embodiments of this disclosure. In other words, a system designed according to an embodiment of this disclosure will not necessarily include all of the features shown in any one of the Figures or all of the portions schematically shown in the Figures. Moreover, selected features of one example embodiment may be combined with selected features of other example embodiments.

The preceding description is exemplary rather than limiting in nature. Variations and modifications to the disclosed examples may become apparent to those skilled in the art that do not necessarily depart from the essence of this disclosure. The scope of legal protection given to this disclosure can only be determined by studying the following claims.

What is claimed is:

1. A furniture hinge comprising:

a carrier arm;

a door fitting having a recessed cup that is rotatably disposed at one end of the carrier arm, a fastening plate adjustably connected to another end of the carrier arm;

a mounting plate that is attachable to a furniture body and longitudinally adjustably attached to the fastening plate such that the mounting plate and fastening plate are movable relative to one another in a longitudinal direction;

wherein one of the fastening plate or the mounting plate includes a guide wall having a width and a thickness and a hole in said thickness of said guide wall, said hole forming a guide slot through said thickness of said guide wall, wherein an entire perimeter of said hole is completely circumscribed by said guide wall, the guide wall arranged such that the width of the guide wall is perpendicular to said longitudinal direction, and the guide wall is bent perpendicularly to a plane of the respective plate, and the other of the fastening plate or the mounting plate includes a guide tongue extending into the hole forming the guide slot and the guide tongue is parallel to a plane of the other respective plate; and a longitudinal adjustment member operable to adjust a position of the fastening plate relative to the mounting plate in the longitudinal direction, the longitudinal adjustment member including a rotatably disposed eccentric component having an eccentric portion that extends into a slot formed in one of the fastening plate or the mounting plate.

2. The furniture hinge according to claim 1, wherein the guide tongue is orientated at right angles to a base plate of the mounting plate.

3. The furniture hinge according to claim 2, wherein the guide wall is bounded by an upper wall of the fastening plate located a distance from the base plate of the mounting plate.

4. The furniture hinge according to claim 1, wherein the fastening plate includes the guide wall and the guide slot and the guide wall is bent perpendicularly to the plane of the fastening plate, and the mounting plate includes the guide tongue extending into the guide slot and the guide tongue is parallel to the plane of the mounting plate.

5. The furniture hinge according to claim 1, wherein the mounting plate includes the guide wall and the guide slot and the guide wall is bent perpendicularly to the plane of the mounting plate, and the fastening plate includes the guide tongue extending into the guide slot and the guide tongue is parallel to the plane of the fastening plate.

6. The furniture hinge according to claim 1, further comprising a lateral adjustment member that is operative to adjust a position of the carrier arm relative to a front wall of the fastening plate that is perpendicular to the fastening plate.

7. The furniture hinge according to claim 6, wherein the front wall of the fastening plate is parallel to and spaced from the guide slot in the guide wall.

8. The furniture hinge according to claim 6, wherein the lateral adjustment member includes a rotatably disposed eccentric component having an eccentric portion that extends into a slot extending along a direction of adjustment.

9. The furniture hinge according to claim 1, wherein the hole extends through the thickness of the respective plate.

10. A furniture hinge comprising:

a carrier arm;

a door fitting having a recessed cup that is pivotally disposed at one end of the carrier arm;

a fastening plate adjustably connected to another end of the carrier arm;

a mounting plate that is attachable to a furniture body, the fastening plate longitudinally adjustably attached to the mounting plate such that the mounting plate and fastening plate are movable relative to one another in a longitudinal direction;

wherein the fastening plate includes a guide wall disposed perpendicular to the plane of the fastening plate, the guide wall having a width and a thickness and a hole in said thickness of said guide wall, the guide wall arranged such that the width of the guide wall is perpendicular to said longitudinal direction, said hole forming a guide slot, and wherein the mounting plate includes a guide tongue formed at an interior end of the mounting plate and matingly received within the hole-forming the guide slot guiding the longitudinal adjustment of the fastening plate relative to the mounting plate; and a longitudinal adjustment member operable to adjust a position of the fastening plate relative to the mounting plate in the longitudinal direction, the longitudinal adjustment member including a rotatably disposed eccentric component having has a pin extending into an opening the mounting plate and an eccentric portion that extends into a slot formed in the fastening plate.

11. The furniture hinge according to claim 10 and further comprising a lateral adjustment member that is operative to adjust a position of the carrier arm relative to a front wall of the fastening plate.

12. The furniture hinge according to claim 11 wherein the lateral adjustment member includes a rotatably disposed eccentric component having an eccentric portion which extends into a slot extending along a direction of adjustment.

13. The furniture hinge according to claim 11 wherein said guide wall is at an end thereof distal from said lateral adjustment member.

14. The furniture hinge according to claim 10 wherein said fastening plate further comprises a second wall parallel to said guide wall for attaching to said carrier arm.

* * * * *